US009189936B2

(12) United States Patent
Schmidt et al.

(10) Patent No.: US 9,189,936 B2
(45) Date of Patent: Nov. 17, 2015

(54) SECURITY TAG FOR A CONTAINER SEAL AND CONTAINER SEAL INCLUDING A SECURITY TAG

(71) Applicant: Fraunhofer-Gesellschaft zur Foerderung der angewandten Forschung e.V., Munich (DE)

(72) Inventors: Jennifer Schmidt, Maxhuette-Haidhof (DE); Anna Hezinger, Regensburg (DE); Matthias Stich, Regensburg (DE); Gerhard J. Mohr, Knittelfeld (AT); Sabine Trupp, Saalfeld (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 241 days.

(21) Appl. No.: 13/895,084

(22) Filed: May 15, 2013

(65) Prior Publication Data

US 2013/0321152 A1 Dec. 5, 2013

(30) Foreign Application Priority Data

May 15, 2012 (DE) ..... 10 2012 009 690
Jun. 27, 2012 (DE) ..... 10 2012 211 067

(51) Int. Cl.

| | |
|---|---|
| ***G08B 13/14*** | (2006.01) |
| ***G08B 13/24*** | (2006.01) |
| ***B65D 55/02*** | (2006.01) |
| ***G09F 3/00*** | (2006.01) |
| *G09F 3/02* | (2006.01) |

(52) U.S. Cl.

CPC ..... *G08B 13/2451* (2013.01); *B65D 55/026* (2013.01); *G09F 3/0292* (2013.01); *G09F 2003/0272* (2013.01)

(58) Field of Classification Search

CPC ..... B65D 55/026; B65D 55/028; B65D 2101/0023; B65D 41/3428; B65D 41/3409; B65D 2101/00; B65D 2101/0084; B65D 2203/00; B65D 55/024; B65D 41/3438; B65D 41/3447; B65D 41/3495; G08B 21/0286; G08B 13/2402; B29L 2031/565; G09F 3/0376; B65B 7/285

USPC ..... 340/572.1–572.9; 215/200, 230, 317, 215/318, 341; 252/299.01, 299.1, 299.2; 73/52; 206/247

See application file for complete search history.

(56) References Cited

U.S. PATENT DOCUMENTS

| | | | | |
|---|---|---|---|---|
| 3,736,899 | A * | 6/1973 | Manske | 116/270 |
| 4,877,143 | A * | 10/1989 | Travisano | 215/230 |
| 5,022,545 | A | 6/1991 | Carson | |

(Continued)

FOREIGN PATENT DOCUMENTS

| | | |
|---|---|---|
| DE | 10158369 | 6/2003 |
| DE | 102005013435 | 9/2006 |

(Continued)

*Primary Examiner* — Travis Hunnings

(74) *Attorney, Agent, or Firm* — Michael A. Glenn; Perkins Coie LLP

(57) ABSTRACT

A security tag for being mounted to a container seal includes a sensor element having a sensor volume which is filled at least partly with an indicator material, an indication area arranged at the sensor volume, and a manipulator element configured to cause, with an abrupt mechanical deformation at the container seal, when opening same, an irreversible, physical and/or chemical alteration of the indicator material which may be perceived visibly or in a tactile manner in the indication area.

9 Claims, 2 Drawing Sheets

(56) References Cited

U.S. PATENT DOCUMENTS

| | | | | | |
|---|---|---|---|---|---|
| 5,152,412 | A | * | 10/1992 | Iler | 215/230 |
| 5,190,175 | A | * | 3/1993 | Schmidt | 215/230 |
| 5,289,929 | A | * | 3/1994 | Heilman et al. | 215/230 |
| 5,413,234 | A | * | 5/1995 | Hekal et al. | 215/230 |
| 6,095,357 | A | * | 8/2000 | Heiner et al. | 215/270 |
| 2012/0248127 | A1 | * | 10/2012 | Wurster et al. | 220/721 |

FOREIGN PATENT DOCUMENTS

| | | |
|---|---|---|
| EP | 2305318 | 4/2011 |
| WO | WO-2006099854 | 9/2006 |

* cited by examiner 10
12
100
14
16
18
20

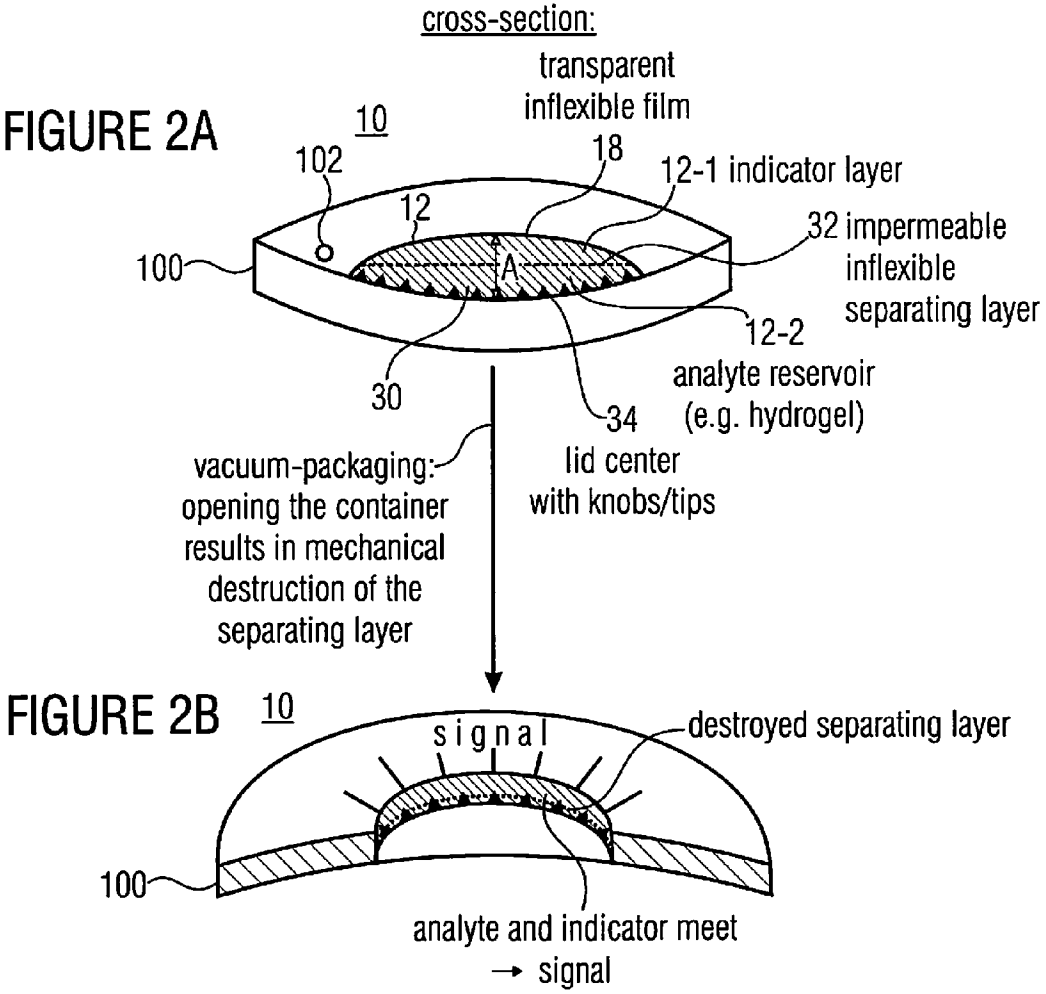
FIGURE 2A
FIGURE 2B
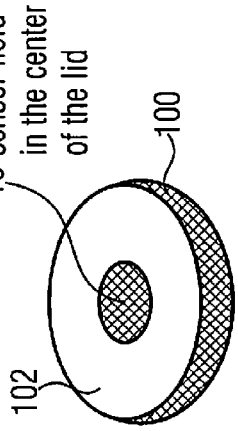
FIGURE 3

SECURITY TAG FOR A CONTAINER SEAL AND CONTAINER SEAL INCLUDING A SECURITY TAG

CROSS-REFERENCE TO RELATED APPLICATIONS

This application claims priority from German Patent Application No. 102012211067.4, which was filed on Jun. 27, 2012, and from German Patent Application No. 10 2012 009 690.9, which was filed on May 15, 2012, which are both incorporated herein by reference in their entirety.

BACKGROUND OF THE INVENTION

The present invention relates to a security tag for being mounted to a container seal, and to a container seal including a security tag. In particular, the present invention relates to a container seal including a security tag (sensor seal) which may be employed basically in all resealable containers having a screw lid for vacuum-packed products, such as, for example, food, in order to indicate reliably whether the container is still originally sealed, whether the packaging is damaged or has already been opened, or whether the seal itself is damaged or untight.

With vacuum-packed food and other products which may be arranged in receptacles or containers including resealable screw lids, it is frequently difficult to judge whether these containers are still originally sealed, whether the packaging is damaged or has already been opened, or whether the seal is damaged or untight. This is particularly critical with regard to food, in particular with baby food, since in this case, after opening the seal lid, the contents or good may decay relatively quickly through contamination with microbial germs. Consuming food gone bad may cause heavy health consequences, in particular for children and elderly people.

"Paper seals" glued to the container over the edge of the container seal are frequently to be found with screw lids for containers. Only after opening the lid will the paper tear and thus indicate that the product has already been opened. However, these paper seals may easily be damaged or torn from outside, thereby pretending that the container has already been opened. Damaging the original seal thus results in an enormous insecurity on the part of consumers, who will not purchase such products and consequently lose confidence in the quality of the products and the manufacturer. Additionally, these containers have to be removed from the shelf and disposed of.

Apart from these sealing systems, there are seals for containers which indicate, using a mechanical process, whether the respective container has already been opened, as is exemplarily shown in the patent publication DE 10 2005 013 435 A1. These seals for containers include an interior part and an exterior part which, after opening the container for the first time, are fixed in a defined angular position to each other, wherein the angular position of the interior part relative to the exterior part may be recognized visually and/or in a tactile manner at the front in the sight opening. However, the setup of these seal lids is relatively complex, rather unclear and relatively complicated and, thus, expensive in manufacturing.

Additionally, there is vacuum-packed food in glasses, such as, for example, baby food, fruit juice, bottled vegetables or fruit and sauces, provided with a seal lid which produces a sound when opening the container, such as, for example, the glass or packaging. However, the sound cannot always be perceived clearly (in particular when opening the seal lid slowly). Recognizing whether the seal lid is still originally sealed is particularly difficult when the consumer is, for example, in a noisy environment, such as, for example, with urban traffic, at a station, in a factory, in kindergarten, etc. Additionally, the sound when opening the container is of no use at all for, for example, persons hard of hearing or deaf persons. These persons will consequently not be able to evaluate whether the product is in a correct state or whether the packaging has been damaged or already been opened, and thus the quality of the food is diminished or whether decay has already started as a consequence of potential microbial contamination.

This increases insecurity on the part of consumers, which is of particularly high importance with baby food and frequently results in unnecessary disposal of food and products which actually are still in a correct state.

Departing from this known technology, it is the object of the present invention to provide a security tag for a container seal by means of which both reliable and also easy visual and/or tactile checking is possible so as to recognize whether a container is still originally sealed or not.

SUMMARY

According to an embodiment, a security tag for being mounted to a container seal may have a sensor element having a sensor volume which is filled at least partly with an indicator material, an indication area arranged at the sensor volume, and a manipulator element configured to cause, with an abrupt mechanical deformation or reset at the container seal (such as, for example, at a lateral or front face), when opening same, an irreversible physical and/or chemical alteration of the indicator material which may then be perceived visually or in a tactile manner in the indication area of the sensor element.

Another embodiment may have a container seal having a security tag mentioned above, wherein the security tag is attached mechanically to the container seal or is integrated into the container seal.

According to another embodiment, a security tag for a container seal, the security tag being mountable to the outside center of the container seal, may have: a sensor element having a sensor volume which is filled at least partly with an indicator material, an indication area arranged at the sensor volume, and a manipulator element configured to cause, with a mechanical deformation at the center of the container seal, when opening same, an irreversible physical and/or chemical alteration of the indicator material which may be perceived visibly or in a tactile manner in the indication area.

The central idea of the present invention is providing a security tag, which may be read out reliably, for being mounted to a container seal and, additionally, a container seal including a security tag attached thereto. The security tag is configured to make use of the fact that, when opening, for example, a container sealed in a vacuum (or negative-pressure atmosphere), opening the container will cause an abrupt mechanical deformation or reset at the container seal. This mechanical deformation is transferred onto the security tag. A manipulator element of the sensor element which is subjected to the mechanical deformation is effective so as to receive an irreversible physical and/or chemical alteration of the indicator material in the indication area of the security tag, wherein this alteration may then be perceived visually or in a tactile manner in the indication area of the security tag.

Opening the container may exemplarily be made visible reliably by a swing in color in the indication area of the security tag on the screw lid seal. It is possible for the consumer by means of a simple visual check of the indication area or sensor field to recognize directly with the naked eye whether the product is still originally sealed and consequently no deterioration in quality of the good packaged is to be expected, or whether the container has already been opened.

The inventive security tag may, for example, also be employed in manufacturing or also in the store for a quality check since such containers which are no longer originally packaged are damaged or have already been opened, or their seal is damaged or untight, may be recognized easily reliably and quickly (also using machines) and sorted out.

Such a security tag for being mounted to a container seal, or a container seal configured to include the security tag ("sensor seal") may be employed in particular with all containers/receptacles including screw lids for vacuum-packed products and food, such as, for example, baby food, bottled vegetables and fruit, fruit juice, soups and sauces, food preparations, animal food, cosmetics, detergents and household articles and medicine.

An inventive security tag for being mounted to a container seal includes a sensor element comprising a sensor volume which is filled at least partly with an indicator material, an indication area arranged at the sensor volume, and a manipulator element configured to cause, with an abrupt mechanical deformation or reset at the container seal, when opening same, an irreversible physical and/or chemical alteration of the indicator material, which may be perceived visibly or in a tactile manner in the indication area.

In one embodiment, the security tag may exemplarily be implemented as a single-chamber arrangement, the sensor element comprising a floor element configured to be connected or coupled mechanically to the container seal. Thus, at least a part of the floor area of the manipulator element is configured to transfer the abrupt mechanical deformation of the container seal, when opening same, onto the indicator material. The indicator material here exemplarily comprises indicator particles in a salt hydrate solution (such as, for example, sodium acetate trihydrate, alum, Glauber salt) in which a process of crystallization may be induced mechanically. Within, the indicator particles bear colorant molecules (such as, for example, fluorescein, triphenylmethane colorants) in a solvent which exemplarily has a melting point >40° C. (depending on the system used) and, below, is present in a crystalline state. With mechanically induced crystallization of the salt hydrate, the crystallization heat (>40° C.) is released, causing the solvent within the indicator particles (such as, for example, tetradecanol with a melting point of 40° C., or pentadecanol with a melting point of 44° C.) to change its state of aggregation, become liquid and dissolve the indicator colorant. The consequence is an alteration in the optical characteristics of the indicator colorant.

In another embodiment, the security tag is, for example, implemented as a two- or multi-chamber arrangement, the sensor element comprising a sensor volume with a first sub-volume containing the indicator material and a second sub-volume containing the analyte material. In a normal state of the security tag, the two sub-volumes are separated from each other by means of a separation element or separation membrane. The manipulator element (such as, for example, in the form of knob-like tips) is configured to make the separation element at least partly permeable for the analyte material or separate the membrane with the abrupt mechanical deformation at the container seal when opening same so as to make contact of the analyte material with the indicator material. Making contact between the analyte material and the indicator material causes an irreversible alteration of an optical or tactile characteristic of the indicator material, making contact with the analyte material, in the indication area of the sensor element.

In another embodiment, the indicator material may comprise indicator particles in the form of capsules which within each contain an indicator colorant or the analyte, the indicator particle being configured to release, with a mechanical deformation transferred by the manipulator element, the colorant or analyte contained within into the surrounding medium which contains analyte or colorant and cause an optical alteration, such as, for example, as a color alteration, in the indication area. These indicator particles may be employed in both embodiments illustrated above.

Additionally, in another embodiment, a container seal may be realized including a security tag, i.e. a so-called sensor seal, the security tag being mechanically coupled to the container seal or integrated into the container seal.

BRIEF DESCRIPTION OF THE DRAWINGS

Embodiments of the present invention will be detailed subsequently referring to the appended drawings, in which:

FIGS. 2*a-b* are schematic basic illustrations of a security tag for a container seal in accordance with another embodiment of the present invention; and FIG. 3 shows a container seal including a security tag in accordance with another embodiment of the present invention.

DETAILED DESCRIPTION OF THE INVENTION

Figures 1A, 1B:
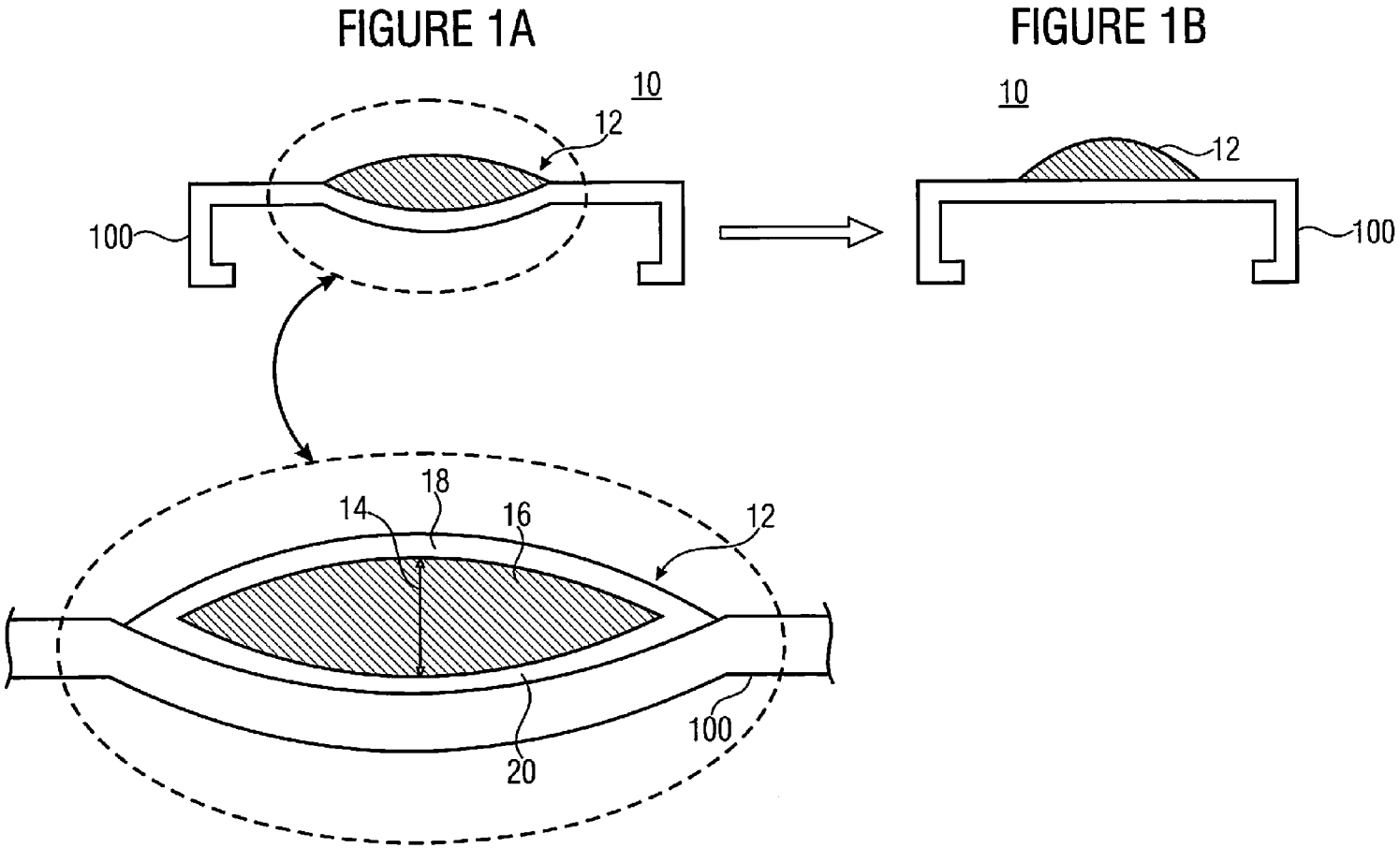
FIGS. 1*a-b* are schematic basic illustrations of a security tag for a container seal in accordance with an embodiment of the present invention.

Before discussing the present invention in greater detail using the drawings, it is to be pointed out that identical elements or structures or elements or structures having the same function or the same effect are provided with same reference numerals in the figures such that the description of these elements illustrated in different embodiments is mutually exchangeable or may be applied mutually.

The basic setup and mode of functioning of a security tag 10 provided for being mounted to a container seal in accordance with an embodiment of the present invention will be described below making reference to FIGS. 1*a-b*. FIG. 1*a* represents a normal state (state 1) of the security tag 10 wherein no deflection or mechanical action caused by reset has taken place, i.e. the container seal including the security tag arranged thereon, for example, is still originally sealed. FIG. 1*a* also illustrates a detail enlargement of the sensor element 12. FIG. 1*b* in contrast illustrates a warning state (state 2) of the security tag 10 wherein deflection or mechanical action has already taken place, i.e. the container seal with the security tag arranged thereon, for example, has already been opened, the container is no longer originally sealed, the packaging is damaged or has been opened already, or the seal is damaged or untight.

The security tag 10 comprises a sensor element 12 comprising a sensor volume 14 which is filled at least partly with an indicator material 16. The sensor element 12 comprises an indication area which is transparent on the entire surface area or, alternatively, only partly such that an alteration of the indicator material 16 in the indication area 18 which may be perceived visibly or in a tactile manner, may be recognized when the normal state has changed to the warning state of the security tag 10. The sensor element comprises a manipulator element 20 which in the embodiment illustrated in FIGS. 1*a-b* is implemented as a floor section of the sensor element 12 so as to cause, with an (exemplarily abrupt) mechanical deformation (lid reset) at the container seal 100, when opening same, an irreversible physical and/or chemical alteration of the indicator material 16 which may be perceived visibly or in a tactile manner in the indication area 18. The floor element 20 of the sensor element 12 is configured to be coupled or connected mechanically to the container seal (exemplarily by means of a glue layer—not shown), wherein at least part of the floor element 20 is configured as the manipulator element so as to transfer the abrupt mechanical deformation of the container seal when opening same onto the indicator material 16.

As is illustrated in FIG. 1*a*, the sensor element may be manufactured to be very flat with a maximum height of less than 1 or 2 mm such that the covering element 18 may basically be arranged to be flush with the container seal (exemplarily flush at a lateral or front face of the container seal). This increases its suitability for daily use since the security tag 10 is not perceived to be disturbing, but belonging to the container seal.

It is pointed out in this context that, in the case of a container seal or lid for a vacuum-packed product, the center of the container seal or center of the lid, when opening the container seal, performs, for example, an abrupt mechanical deformation or reset of the deformed material of the center of the container seal. This usually generates a typical sound (plop or click sound) when opening a container seal for a vacuum-packed product.

The indicator material 16 may exemplarily include indicator particles in a salt hydrate solution (such as, for example, sodium acetate trihydrate, alum, Glauber salt) in which a crystallization process may be induced mechanically. Within, the indicator particles carry colorant molecules (such as, for example, fluorescein, triphenylmethane colorants) in a solvent which exemplarily has a melting point >40° C. (depending on the system used) and, below, is in a crystalline state. With mechanically induced crystallization of the salt hydrate, crystallization heat (>40° C.) is released, causing the solvent within the indicator particles (such as, for example, tetradecanol with a melting point of 40° C., or pentadecanol with a melting point of 44° C.) to change its state of aggregation, become liquid and dissolve the indicator colorant. The alteration in the state of aggregation may cause an alteration, which may be perceived optically and in a tactile manner, in the indication area 18 of the sensor element 12. The optical characteristic may exemplarily be a change in colors in the visible region.

Expressed generally, the optical characteristic which alters selectively due to the mechanically induced interaction, may be an absorption wavelength, absorption intensity, circular dichroism, reflection feature, transmission feature, refraction of light, light scattering, polarization of light, emission wavelength, emission intensity, emission decay time (fluorescence or phosphorescence decay time).

A pressure wave or acoustic shock wave caused by the abrupt mechanical deformation or reset at the container seal when opening same (caused by the "clicking" of the metal of the container seal) is responsible for triggering the crystallization process, thereby mechanically inducing, connected thereto, the formation of crystallization seeds (for triggering the crystallization process) in the salt hydrate indicator material 16.

Additionally, the indicator material 16 may include a liquid-crystal material and be configured such that the mechanical deformation of the seal, when opening the container, causes an alteration in the spatial arrangement of the molecules within the liquid-crystal medium, resulting in a change in the optical characteristic of the liquid crystals.

In addition, the indicator material 16 or liquid-crystal material may additionally comprise reflecting pigments, wherein a change in the spatial arrangement of the molecules and/or pigments within the indicator material, due to the mechanical deformation of the seal when opening the container, results in an alteration in the optical characteristic of the liquid crystals and/or the reflecting pigments.

Liquid-crystalline materials are characterized by the fact that they are liquid and thus exhibit features of a liquid and, at the same time, an isotropic (i.e. direction-dependent) physical features as occur in a crystal. Amphiphile substances (such as, for example, surfactants, cholesterol and derivatives thereof) in a solvent (such as, for example, $H_2O$), in a certain concentration, form so-called lyotropic liquid crystals, i.e. sub-microscopic structures form, such as, for example, micelles or vesicles, which are arranged symmetrically in the solvent. This gives liquid-crystalline materials their anisotropic physical characteristics.

The color swings visible in the indication area 18 which form as a consequence of temperature changes, for example in an exothermal or endothermal crystallization process, or by mechanical deformation of the sensor element, may be used according to the invention so as to indicate the normal state, i.e. container seal is sealed, or the warning state, i.e. container seal has been opened.

Since the alteration in the optical characteristic takes place within only a few seconds, the security tag described before using FIGS. 1*a-b* exhibits a reasonable response time.

As an alternative to using salt hydrates and indicator particles and liquid-crystalline materials as an indicator material, indicator particles only may be used as the indicator material 16 instead. Such indicator particles may exemplarily be in the form of capsules which, depending on the setup of the system, contain an indicator colorant or analyte as a material within. In the medium surrounding the capsules, there is the analyte or indicator colorant. The capsules may exemplarily be configured to release, with a mechanical deformation transferred by the manipulator element or floor element or reset of the container seal, the colorant or analyte contained therein and cause optical alteration, such as, for example, a change in color, in the indication area 18 of the sensor element. In this embodiment, the capsules of the indicator material 16 are crushed by the manipulator element 20 so as to release the colorant or analyte, resulting in a change in the optical characteristic of the indicator colorant (such as, for example, a color swing).

The basic setup and mode of functioning of the security tag 10 for being mounted to a container seal in accordance with another embodiment of the present invention will be described below referring to FIGS. 2*a-b*.

As is illustrated in FIG. 2*a*, the security tag 10 comprises a sensor element 12 comprising a first sub-volume 12-1 (indicator layer) with the indicator material 16 and a second sub-volume 12-2 (analyte reservoir) with an analyte material 30. In a normal state of the security tag 10, the first and second sub-volumes 12-1, 12-2 are separated from each other by means of a separating element 32, such as, for example, in the form of an impermeable inflexible separating layer. The indication area 18 (such as, for example, a transparent inflexible film) is arranged at the first sub-volume 12-1 with the indicator material 16. The manipulator element 34 in turn is configured to cause, with an (exemplarily abrupt) mechanical deformation or reset at the container seal, when opening same, an irreversible physical and/or chemical alteration of the indicator material 16 which may be perceived visibly or in a tactile manner in the indication area 18. In accordance with the embodiment illustrated in FIGS. 2*a-b*, the manipulator element 34 is configured to make, with the (abrupt) mechanical deformation at the container seal, when opening same, the separating element 32 at least partly permeable for the analyte material 30 (in the direction towards the indicator material 16) and to make contact between the analyte material 30 and the indicator material 16.

The manipulator element 34 may exemplarily be implemented to be a knob-like arrangement provided with tips which is arranged at the floor element 20, directed to the center, within the second sub-volume 12-2 to punch through or destroy mechanically, when resetting the container seal, the separating element 32 which is exemplarily implemented as an impermeable inflexible membrane such that the analyte material 30 may penetrate into the first sub-volume 12-1 with the indicator material 16 through the holes formed in the separating layer 32. The indicator material 16 and the analyte material 30 are configured such that an irreversible alteration of an optical or tactile characteristic of the indicator material (making contact with the analyte material) in the indication area 18 of the sensor element 10 is caused by making contact between the analyte material 30 and the indicator material 16.

The optical characteristic of the indicator material 16 which changes by making contact with the analyte material is, for example, an absorption wavelength, absorption intensity, emission wavelength, emission intensity or emission decay time of the indicator material. In particular, a change in color or an alteration of the fluorescence characteristic in the indication area of the security tag can be indicated reliably when a container seal provided with the inventive security tag is opened.

Expressed generally, the indicator material (at least in the indication area) may be implemented such that the optical characteristic which changes selectively due to the contact or interaction with the analyte material is an absorption wavelength, absorption intensity, circular dichroism, reflection characteristic, transmission characteristic, refraction of light, light scattering, polarization of light, emission wavelength, emission intensity, emission decay time (fluorescence or phosphorescence decay time). In addition, the indicator material or indicator colorant may be embedded into nano or micro particles and may be connected to a polymer material or nano/micro particles which are exemplarily introduced into a polymer material, by means of covalent bonding.

Based on the type, composition and/or amount of the indicator material and the analyte material making contact with the indicator material, a predetermined perceivable or detectable change in the optical characteristic may be achieved, exemplarily in the form of an alteration in color and/or brightness of the indicator material making contact with the analyte material in the indication area.

pH-sensitive indicator colorants are particularly suitable as material pairs and, correspondingly, acids or bases as analyte. Depending on the color swing desired, indicator colorants, such as, for example, thymol blue, methyl orange, bromokresol green, litmus, methyl red, indigo carmine, alizarin yellow R, thymolphthalein, phenolphthalein, bromothymol blue and others may be employed. It is also conceivable to use complexometric indicators as indicator colorants (such as, for example, murexide, tiron, calcon carboxylic acid, thorin, eriochrome black T, diphenyl carbazone, xylenol orange and others), correspondingly the metal ions suitable for the respective complex partners would be present in the analyte reservoir.

The sensor element 12 in turn comprises a floor element 20 configured to be connected mechanically to the container seal 100 (such as, for example, at a lateral or front face 102 thereof). In addition, the sensor element 12 comprises a covering element 18 which provides the indication area and is transparent at least in the indication area 12. The covering element 18 is, for example, formed of a rigid material, like a transparent inflexible film. The covering element is, in particular, configured to allow, up to a force acting of 5 kg/cm$^2$, a vertical deformation of less than 10% referenced to the inner distance A between the floor element and the covering element (present in the normal state of the security tag).

The basic setup and mode of functioning of a container seal 100 comprising a security tag 10 will be described below referring to FIG. 3, wherein the security tag 10 is configured in accordance with one of the embodiments described before and is coupled mechanically to the container seal 100 or integrated into the container seal 100.

In accordance with embodiments of the present invention, the security tag 10 is used for a container seal 100, wherein opening the container is made visible by a color swing on the screw lid seal in a sensor field 18. Using this easy visual check, it is possible for the consumer to recognize with the naked eye whether the product is still originally sealed and therefore no deterioration in quality of the good packaged is to be expected.

In accordance with embodiments of the present invention, sensor elements may be taken into account in which crystallization process which cause a change in the state of aggregation and thus make visible or noticeable whether the original seal has been opened or not, are triggered by mechanical induction. Color swings forming as a consequence of changes in temperature in, for example, a crystallization process (exothermal/endothermal processes) or by a change in the condition of the sensor element with regard to its physical-chemical characteristics when using liquid-crystalline systems or reflecting pigments may also be involved. The alteration in the spatial arrangement of molecule/pigments within the sensor element, which arises with crystallization, results in an alteration in the optical characteristics of the liquid crystals or reflecting pigments.

Additionally, optical sensor fields in which visual color swings take place following an analyte-indicator interaction may also be used. The area for the color swing (the sensor field) here is to be arranged at the cover lid on the upper surface thereof or be integrated therein. It includes a multilayer setup (see FIG. 1) and includes an analyte reservoir (such as, for example, a hydrogel/$H^+$) which is separated from an overlying indicator layer by an inflexible impermeable separating layer. When the seal of the vacuum-packed product is opened, the center of the seal which is, for example, provided with small knob-like tips, shoots up. This causes a mechanical destruction of the separating layer and the analyte can penetrate into the indicator layer through the holes formed, resulting in a visible color swing. This color swing is irreversible, perceivable with the naked eye and may be observed in the seal top view through a transparent inflexible film below which the indicator colorant is applied. In this way, a color swing caused by voluntary pushing is avoided. This invention also includes using fluorescent colorants, evaluation of which may take place using corresponding measuring gadgets. Furthermore, micro and nano indicator particles (such as, for example, white particles (capsules), which contain colorants within which are released when crushed) may also be involved.

The advantage of all the embodiments of the present invention described here is that the sensor does not make direct contact with the food or other vacuum-packed products since it is applied to the outside of the seal. This allows bypassing the strict guidelines of food laws when introducing this sensor seal; i.e. many time-consuming tests and bureaucratic efforts could be omitted.

In addition, sensor layers on corresponding transparent substrates can be manufactured on a large scale easily and, after a short time, cheaply using manufacturing techniques, such as, for example, screen printing, web coating, inkjet printing, or by dispensing.

The visual check also allows evaluating the integrity of the original packaging in a noisy environment. Persons hard of hearing or deaf persons may also evaluate the vacuum-packed goods by applying a sensor field on the seal lid which, after opening the container, indicates a color swing visible to the naked eye or a change in the state of aggregation.

When applying the sensor field on the top surface of the seal, it is of further advantage that, with containers, like for example for drinks stored in a box, it becomes recognizable at first sight to the bottle lid whether the container has already been opened or not. In addition, the innovative lid comprising an integrated sensor field is optically very appealing, which may be made use of as a sales strategy for marketing.

With regard to the embodiments described before, it is to be pointed out that the term "irreversible" is to be understood in a way meaning that a physical and/or chemical alteration of the indicator material does not return to its original state (without taking complicated measures). This means, as long as the indicator material is not manipulated further, for example by heating up the sensor element extremely or opening the sensor volume of the security tag so as to bring the indicator material subjected to a physical and/or chemical alteration back to the original state or a similar state by means of further treatment or manipulation.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A security tag for a container seal, comprising:

a sensor element comprising a sensor volume which is filled at least partly with an indicator material, an indication area arranged at the sensor volume, and a manipulator element configured to cause, with a mechanical deformation at the container seal, when opening same, an irreversible physical and/or chemical alteration of the indicator material which is perceivable in the indication area in a visible or tactile manner, wherein the sensor element comprises a floor element for mechanical coupling to the container seal, wherein at least a part of the floor element forms the manipulator element so as to transfer the mechanical deformation of the container seal, when opening same, onto the indicator material in the sensor volume, and wherein the indicator material comprises a salt hydrate material with indicator particles in which a crystallization process may be induced mechanically.

2. The security tag in accordance with claim 1, wherein an alteration in the state of aggregation of the salt hydrate material causes an alteration, perceivable optically or by tactile means, in the indication area of the sensor element.

3. The security tag in accordance with claim 2, wherein an optical characteristic is a color swing in the visible region, change in the absorption wavelength, change in the absorption intensity, change in the emission wavelength, change in the emission intensity or change in an emission decay time.

4. The security tag in accordance with claim 1, wherein an optical indication in the indication area is associated to one of two states in the form of a normal state of a security tag and a warning state of the security tag.

5. A security tag for a container seal, comprising:

a sensor element comprising a sensor volume which is filled at least partly with an indicator material, an indication area arranged at the sensor volume, and a manipulator element configured to cause, with a mechanical deformation at the container seal, when opening same, an irreversible physical and/or chemical alteration of the indicator material which is perceivable in the indication area in a visible or tactile manner, wherein the indicator material comprises indicator particles in the form of capsules which each comprise a colorant or analyte material within, and the analyte or colorant is in the medium surrounding the capsules, wherein the indicator particles are configured to release the colorant or analyte contained within and cause an optical alteration in the indication area with a mechanical deformation transferred by the manipulator element.

6. A security tag for a container seal, comprising:

a sensor element comprising a sensor volume which is filled at least partly with an indicator material, an indication area arranged at the sensor volume, and a manipulator element configured to cause, with a mechanical deformation at the container seal, when opening same, an irreversible physical and/or chemical alteration of the indicator material which is perceivable in the indication area in a visible or tactile manner, wherein the sensor volume comprises a first sub-volume with the indicator material and a second sub-volume with an analyte material which are separated from each other in a normal state of the security tag by means of a separating element, and wherein the manipulator element is configured to make, with the mechanical deformation at the container seal, when opening same, the separating element at least partly permeable for the analyte material and make contact between the analyte material and the indicator material.

7. The security tag in accordance with claim 6, wherein the indicator material and the analyte material are configured such that an irreversible change in an optical or tactile characteristic of the indicator material, making contact with the analyte material, in the indication area of the sensor element is caused by making contact between the analyte material and the indicator material.

8. The security tag in accordance with claim 7, wherein the optical characteristic of the indicator material altering by making contact to the analyte material is an absorption wavelength, absorption intensity, emission wavelength, emission intensity or emission decay time of the indicator material.

9. The security tag in accordance with claim 6, wherein the sensor element comprises a floor element for mechanical coupling to the container seal and, additionally, a covering element which is transparent at least in the indication area, the covering element being formed of a rigid material.

* * * * *